US006802303B2

(12) United States Patent
Håkansson

(10) Patent No.: US 6,802,303 B2
(45) Date of Patent: Oct. 12, 2004

(54) VALVE DEVICE FOR PRESSURE CONTROL IN A COMBUSTION ENGINE, AND A METHOD FOR SUCH PRESSURE CONTROL

(75) Inventor: Nils-Olof Håkansson, Brastad (SE)

(73) Assignee: Volvo Lastvagnar AB, Göteborg (SE)

( * ) Notice: Subject to any disclaimer, the term of this patent is extended or adjusted under 35 U.S.C. 154(b) by 0 days.

(21) Appl. No.: 10/605,170

(22) Filed: Sep. 12, 2003

(65) Prior Publication Data

US 2004/0112347 A1 Jun. 17, 2004

Related U.S. Application Data

(63) Continuation-in-part of application No. PCT/SE02/00332, filed on Feb. 27, 2002.

(30) Foreign Application Priority Data

Mar. 13, 2001 (SE) ..... 0100852

(51) Int. Cl.[7] ..... F02M 27/00
(52) U.S. Cl. ..... 123/574
(58) Field of Search ..... 123/572–574

(56) References Cited

U.S. PATENT DOCUMENTS

| | | | | |
|---|---|---|---|---|
| 3,709,204 A | * | 1/1973 | Noponen | 123/574 |
| 4,373,499 A | * | 2/1983 | Bendig | 123/574 |
| 4,856,487 A | | 8/1989 | Furuya | 123/574 |
| 5,090,393 A | | 2/1992 | Holch | 123/574 |
| 5,582,145 A | * | 12/1996 | Aizawa et al. | 123/196 CP |
| 6,112,707 A | * | 9/2000 | Kirk | 123/65 BA |
| 6,606,982 B1 | * | 8/2003 | Stockhausen et al. | 123/572 |

FOREIGN PATENT DOCUMENTS

| | | |
|---|---|---|
| EP | 0724206 A2 | 7/1996 |
| EP | 0896133 A1 | 2/1999 |
| GB | 1358797 A | 7/1974 |

* cited by examiner

*Primary Examiner*—Marguerite McMahon
(74) *Attorney, Agent, or Firm*—Novak Druce LLP

(57) ABSTRACT

Method and device (15) for pressure control in a combustion engine (1) with a crankcase (11) to which crankcase gases are guided during operation of the engine. The valve device (15) is adapted for detecting the current pressure in the crankcase (11) and for opening and closing, respectively, a connection (35) between the crankcase (11) and a suction pipe (9) of the engine depending on the detected pressure. The valve device (15) includes a first valve (19) which is adapted for assuming a condition between a first, opened position and a second, closed position depending on the detected pressure in the crankcase (11), and a second valve (20) which is adapted for assuming a condition between a first, opened position and a second, closed position depending on the condition of the first valve (19). The invention also relates to a method for such pressure control. By means of the invention, an improved device for ventilating crankcase gases is provided, wherein in particular an accurate control of the pressure in the crankcase is provided.

11 Claims, 3 Drawing Sheets

VALVE DEVICE FOR PRESSURE CONTROL IN A COMBUSTION ENGINE, AND A METHOD FOR SUCH PRESSURE CONTROL

CROSS REFERENCE TO RELATED APPLICATIONS

This present application is a continuation-in-part patent application of International Application No. PCT/SE02/00332 filed 27 Feb. 2002 which was published in English pursuant to Article 21(2) of the Patent Cooperation Treaty, and which claims priority to Swedish Application No. 0100852-3 filed 13 Mar. 2001. Both applications are expressly incorporated herein by reference in their entireties.

BACKGROUND OF INVENTION

1. Technical Field

The present invention relates to a valve device for pressure control in a combustion engine with a crankcase to which crankcase gases are guided during operation of the engine. The valve device is adapted for detecting the current pressure in the crankcase, and for opening and closing a connection between the crankcase and a suction pipe of the engine, depending on the detected pressure.

The invention also relates to a method for pressure control in a combustion engine that comprises (includes, but is not limited to) feeding crankcase gases, during operation of the engine, from a crankcase that forms part of the engine. The current pressure in the crankcase is detected, and a connection between the crankcase and a suction pipe of the engine is opened and closed depending on the detected pressure.

2. Background

In the field of vehicles provided with a combustion engine, various methods are utilized for treating the gases that are fed out from the engine in connection with combustion occurring therein. In this case, such exhaust gas treatment takes place for various reasons such as demands regarding purification of harmful pollutants in the exhaust gases and requirements regarding the engine's fuel economy and service life.

In this connection, it is previously known to utilize arrangements for ventilating crankcase gases out from the engine's crankcase. The crankcase gases are generated during operation in the respective combustion chambers of the engine and include a comparatively high concentration of hydrocarbons that can be combusted. The crankcase gases are guided from the combustion chamber, between the respective cylinder foder and piston rings of the respective engine cylinder, and then further on to the engine's crankcase.

For environmental reasons, it is normally not acceptable to discharge the crankcase gases into the atmosphere. For this reason, it previously known to feed the crankcase gases from the engine's crankcase back to a suitable point in connection with the engine's inlet side. By means of such closed crankcase ventilation, the gases can be sucked into the engine's air intake for combustion in the engine. By means of this return of the crankcase gases back to the engine's inlet side, the discharges of harmful pollutants from the engine is reduced.

One problem that arises in connection with previously known arrangements of the above-mentioned type is that the crankcase gases normally contain a certain amount of oil in the form of small oil particles. This is due to the fact that the crankcase gases enter the engine's oil sump where a certain part of the lubricating oil is transformed into a liquid "mist" that has small drops of oil. If these oil particles are allowed to return to the engine's inlet side, undesirable coatings can form, for example, in the engine's combustion chambers and on the valves.

The above-mentioned problem particularly concerns engines provided with turbine combinations. For example, today's diesel engines for commercial vehicles are often provided with systems for turbo charging in which an increased amount of air is compressed in a compressor, and then fed into the engine. Normally, such systems also include an intercooler for cooling the air after being fed through the compressor. If the crankcase gases are fed to the compressor, the oil particles in the crankcase gases may cause a coating in the compressor that can result in an impaired efficiency in the compressor. Furthermore, the oil particles may cause a coating in the intercooler, which results in an impaired efficiency in the intercooler. Still further, there is a risk of the oil drops being sucked into the engine.

In order to solve the above-mentioned problems by way of preventing oil particles from being carried along with the crankcase gases to the engine's suction pipe, various types of separation devices are utilized that are provided between the crankcase and the engine's inlet pipe. For example, so-called screen separators, baffle separators and fine separators are utilized for separating the oil particles from the crankcase gases in different manners.

Furthermore, it can be assumed that the pressure in the crankcase normally must be kept very close to the surrounding atmospheric pressure since a too high overpressure in the crankcase may result in oil leakage out of the engine. In a corresponding manner, an undesired underpressure may result in penetration of dirt, via the engine's gaskets, and further into the engine. Thus, there is a demand for accurate control of the pressure in the crankcase to maintain it within a predetermined acceptable interval.

SUMMARY OF INVENTION

One objective of the present invention is to provide a valve device for efficient ventilation of crankcase gases in a combustion engine, namely by maintaining an internal pressure within a prescribed range of atmospheric pressure.

This object is achieved by means of a valve device of the type described above, and is characterized by the fact that it includes a first valve adapted for assuming a condition or configuration between a first, opened position and a second, closed position depending on the detected pressure in the crankcase. A second valve is also included and adapted for assuming a condition or configuration between a first, opened position and a second, closed position depending on the condition or configuration of the first valve.

The object is also achieved by means of a method that includes controlling a first valve between a first, opened position and a second, closed position depending on the detected pressure in the crankcase, and controlling a second valve between a first, opened position and a second, closed position depending on the condition of the first valve.

Several advantages are attained by means of the invention. Primarily, it can be noted that the pressure in the crankcase can be controlled within a comparatively narrow predefined interval. This control is provided by in a servo-like functional manner regarding the two valves.

Preferably, the first valve comprises a flexible diaphragm which, depending on the detected pressure in the crankcase, causes a valve element to open and close an opening which connects the first valve with the second valve. Furthermore, the second valve preferably comprises a flexible diaphragm that, depending on the condition or configuration (open versus closed) of the first valve, is adapted to open and close the connection. In this manner, it is provided that the first valve can be formed so that the valve element only makes small movements during the pressure control process. As a consequence, the diaphragm in the first valve can be made comparatively small, which thus corresponds to small diaphragm movements and an insubstantial undesired influence from disturbing factors, for example forces which act from the diaphragm itself. This creates conditions for an accurate control, at the same time as the valve device can be constructed in a compact manner.

BRIEF DESCRIPTION OF DRAWINGS

The invention will now be exemplarily described with reference to a preferred embodiment and to the annexed drawings, in which.

DETAILED DESCRIPTION

Figure 1:
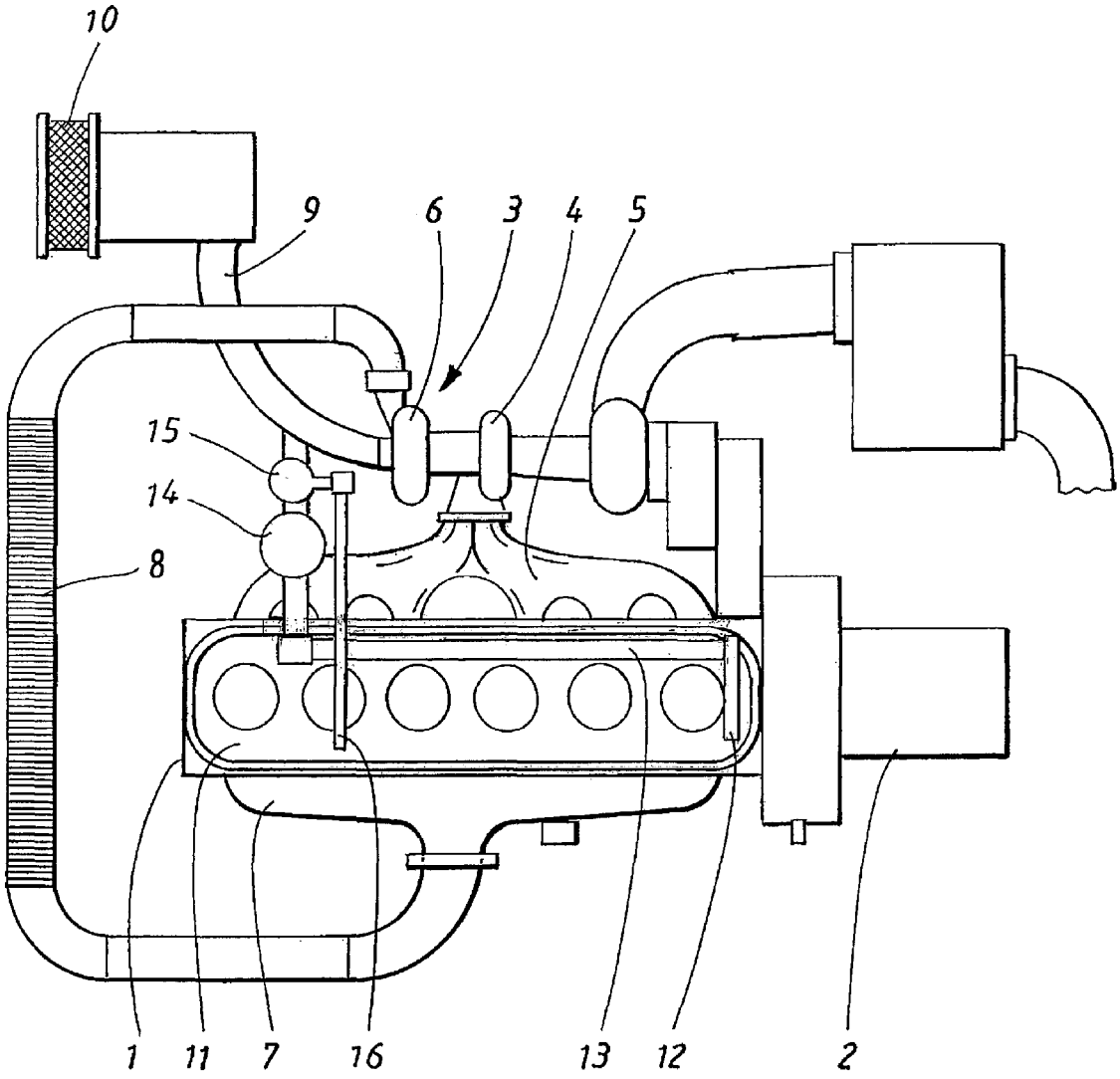
FIG. 1 is a schematic side view of an exemplary arrangement associated with a combustion engine and in which the present invention can be utilized.

FIG. 1 shows a schematic, assembled view of an arrangement configured according to the teachings of the present invention. According to the preferred embodiment, the invention is provided in connection with an engine block 1 in a six-cylinder, four-stroke, diesel engine with a gear box 2 and a clutch that is connected to the engine's crankshaft.

The engine is overloaded by means of a turbo compressor 3 of known type, which in turn comprises a turbine 4 connected to the engine's exhaust manifold 5 and a compressor 6 connected to the engine's induction (air intake) manifold 7 via an intercooler 8. By way of a suction pipe 9, the suction side of the compressor 6 is connected to an air filter 10.

As described above, crankcase gases are generated in the engine and will be guided from the respective combustion chamber of the engine and into its crankcase 11. This takes place mainly as a consequence of non-sealed piston rings between the engine's pistons and the walls in the respective cylinders. Crankcase gases contain small particles in the form of oil drops, and for reasons which have been mentioned above, there is a demand for separating these particles from the gases. To this end, the engine's crankcase 11 comprises a generally known screen separator 12 (which is generally known, and therefore shown schematically) and a baffle separator 13. From the baffle separator 13, the crankcase gases are guided further onto a fine separator 14.

As previously mentioned, there is a demand for controlling the exiting pressure in the crankcase 11. To this end, the present inventive arrangement includes a valve device or means 15, the construction and function of which will be described in detail below. A connection, in the form of a pipe 16, connects the inside of the crankcase 11 with the valve device 15. In this manner, the valve device 15 is adapted for continuous detection of the pressure in the crankcase 11.

The valve device 15 will now be described with reference to FIG. 2, which is a schematic cross-sectional view in which the crankcase 11 with the various separation devices is shown. The drawing also shows an oil sump 17 and a drain pipe 18 for draining the oil particles which have been separated by means of the separation devices, so that the oil particles are guided back to the oil sump 17.

When controlling the pressure in the crankcase 11, it is necessary that this pressure be kept very close to the surrounding atmospheric pressure; more precisely, slightly above the atmospheric pressure. Otherwise, a too high overpressure could result in an undesired oil leakage and a too great underpressure would result in penetration of dirt into the engine via its gaskets (not shown). Suitably, the pressure in the crankcase 11 can be kept within an interval of the order of 0–65 mm water column. Furthermore, an underpressure prevails in the suction pipe 9. This underpressure can vary during the operation of the engine, for example depending on the load of the engine being experienced. An underpressure that corresponds to 0–650 mm water column is normal. In this connection, it can be assumed that the surrounding atmospheric pressure constitutes a reference with the pressure 0 mm water column.

The invention is not limited for utilization in engine arrangements in which the above-mentioned pressure intervals prevail, but may in principle be utilized in any arrangements where there is a demand for maintaining a pressure in the crankcase and the suction pipe, respectively, which is within predetermined intervals.

Thus, the invention is based on the demand for controlling the pressure in the crankcase 11 within a predetermined, comparatively narrow, permissible pressure interval. To this end, according to the present invention, a valve device or arrangement 15, as defined herein, is utilized as described in greater detail below.

The valve device 15 comprises two separate valve units; more precisely, a first valve 19 and a second valve 20. Both of these valves 19, 20 are preferably of the type which is based on a surrounding gas pressure acting upon a flexible diaphragm, preferably constructed of rubber, so that it is moved depending on the pressure which acts against the diaphragm. This movement of the diaphragm in turn affects a control mechanism for a gas flow. According to the illustration of FIG. 2, the first valve 19 comprises a first rubber diaphragm 21, which via an upper and a lower valve disc 22, 23 is mounted in a displaceable valve rod 24. This valve rod 24 is provided with a valve element 24*a* that is adapted to sealingly co-operate with an opening 25 in an intermediate wall 26, and in turn separates the first valve 19 from the second valve 20. In this manner, the opening 25 constitutes a connection between the first and the second valve.

Furthermore, the diaphragm 21 in the first valve 19 is arranged so that it separates a first chamber 27 from a second chamber 28. The first chamber 27 is connected with the surrounding atmosphere, while the second chamber is connected with the crankcase 11, via the pipe 16 which connects to the crankcase 11. Thus, the pressure in the second chamber 28 is just as high as the pressure in the crankcase 11; that is, equal thereto.

The second valve 20 comprises a second rubber diaphragm 29 and two additional valve discs 30, 31. In a corresponding manner to the first valve 19, the second rubber diaphragm 29 is adapted so that it separates a third chamber 32 from a fourth chamber 33. The third chamber 32 is connected with the suction pipe 9, via a narrow connection 34 that functions as a restrictor. According to the illustrated embodiment, the fourth chamber 33 is connected with the outlet of the fine separator 14 as shown in FIG. 1, and the fourth chamber 33 is provided downstream of all separation devices, via an opening 35. The fourth chamber 33 is also connected with the suction pipe 9. Furthermore, the second valve 20 is connected with a spring element 35, which is adapted so that the second rubber diaphragm 29 is influenced towards the opening 35; that is to say, the second valve 20 strives to seal against the opening 35. In this manner, this sealing function is provided by means of the fact that the lower valve disc 31 in the second valve 20 sealingly bears against a surface which surrounds the opening 35, as shown in FIG. 2.

Figure 2:
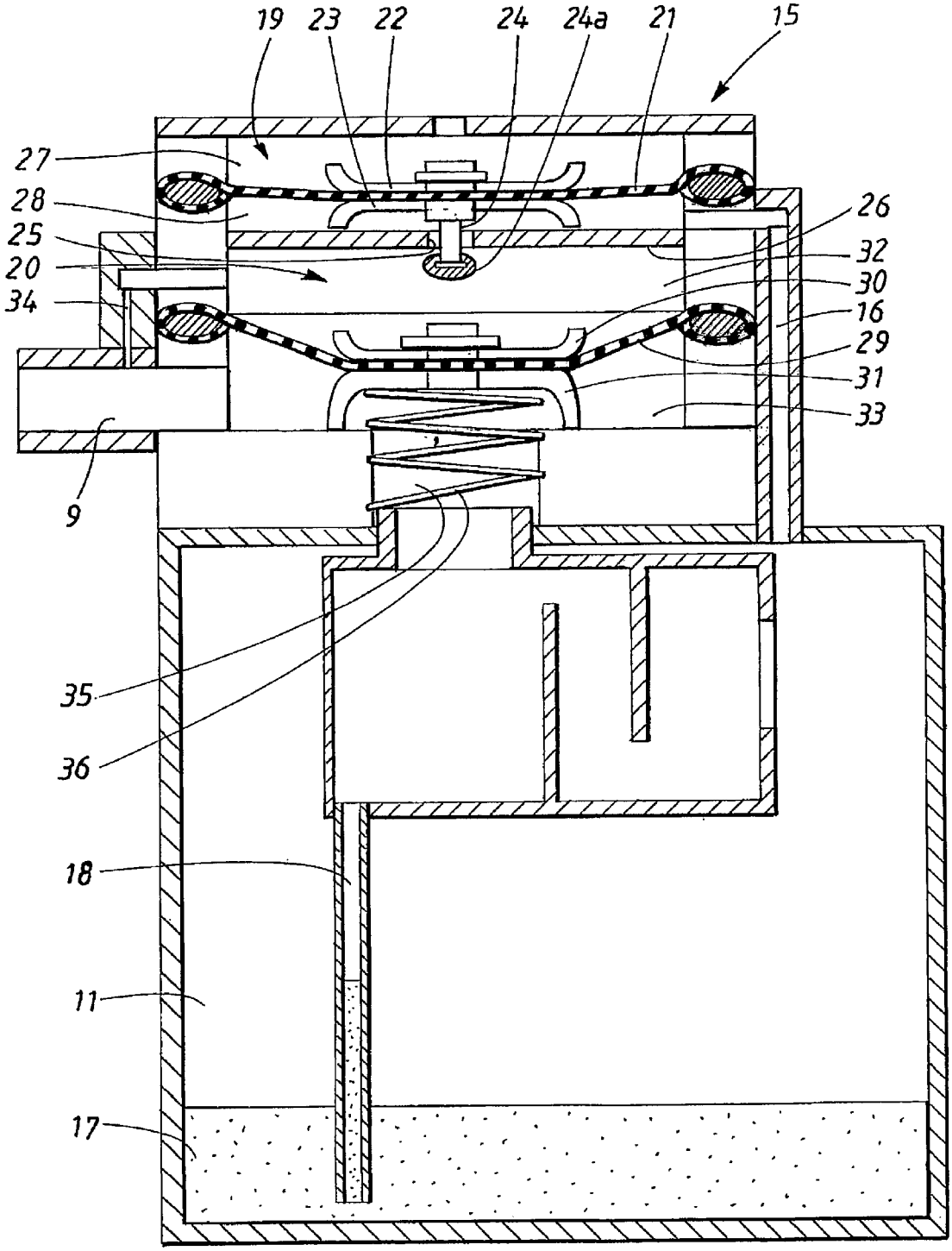
FIG. 2 is a schematic cross-sectional view showing a valve device configured according to the invention.
Figure 3A:
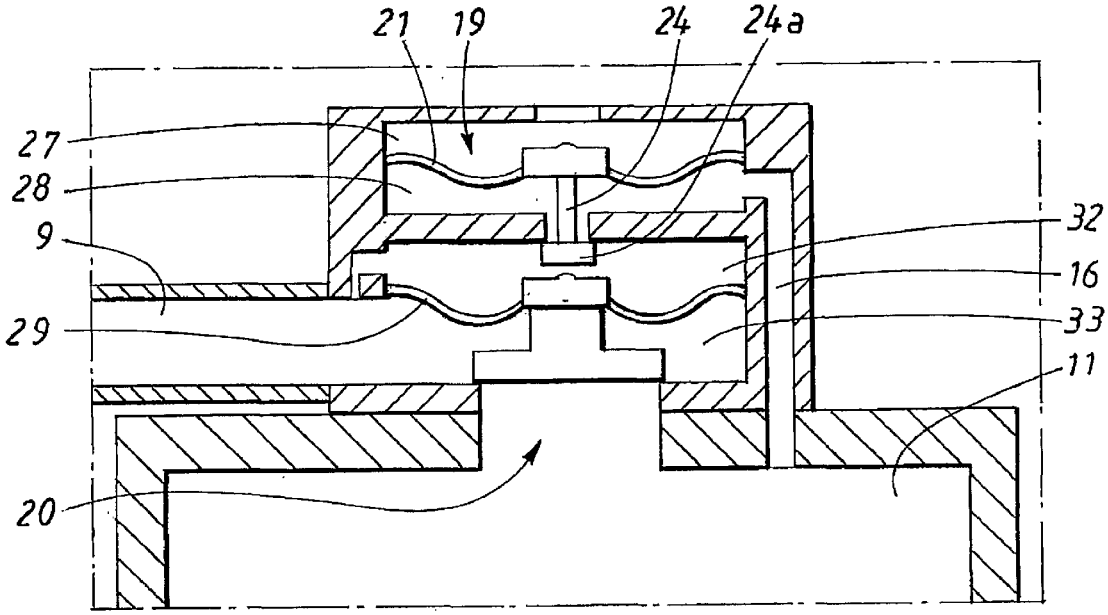
FIGS. 3*a–c* are schematic cross-sectional views showing the functional manner of the invention.

Referring to FIG. 3*a,* which is a schematic cross-sectional view showing the function of the valve device 15 (and where certain details have been omitted in relation to what is shown in FIG. 2), the first valve 19, as well as the second valve 20, are in their closed positions when the pressure in the crankcase 11 and the suction pipe 9, respectively, lies within their desired intervals. To this end, the components forming parts of the valves, and the spring element 36 (not apparent from FIG. 3*a*) and the restrictor 34, are formed and provided so that the first valve 19 seals against the first opening 25, while the second valve 20 seals against the second opening 35, thus constituting a connection between the crankcase 11 and the suction pipe 9.

It can be noted that the slight overpressure which occurs during normal conditions prevails in the crankcase 11, and thus also in the pipe 16, and affects the first rubber diaphragm 21 in a manner which results in that the valve rod 24, with the valve element 24*a* associated therewith, is transferred towards its corresponding opening 25, wherein the valve element 24*a* sealingly bears against its corresponding opening 25. Furthermore, the second valve 20 is affected by means of the spring element 36 in a direction so that the opening 35 between the crankcase and the suction pipe 9 is blocked. During this normal condition shown in FIG. 3*a,* the pressure in the third chamber 32 is just as large as that in the suction pipe 9.

Figure 3B:
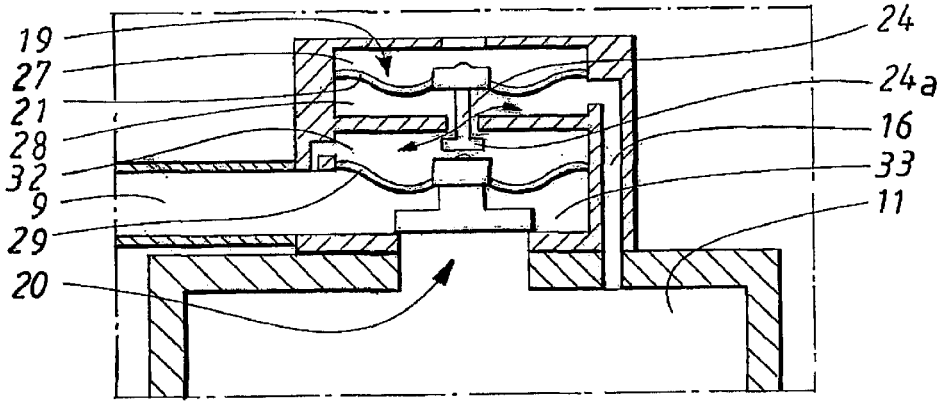

If the pressure in the crankcase 11 should drop below a minimum permissible limiting value, this low pressure will result in that the first diaphragm 21 is influenced in a direction that results in that the valve element 24*a* no longer seals against its corresponding opening 25. This condition is shown in FIG. 3*b*. Thus, a passage of crankcase gases from the crankcase 11 is in this case allowed, via the pipe 16 and the second chamber 28, to the third chamber 32. In this manner, the pressure of the crankcase gases in the third chamber 32 will be maintained at a value that corresponds with the pressure in the crankcase 11. In this condition, the second valve 20 is closed and allows no passage of crankcase gases to the suction pipe 9 via the opening 35. This in turn results in that the pressure in the crankcase 11 increases. During this course of events, there will be a certain flow of crankcase gases from the third chamber 32, via the restrictor 34, and further on to the suction pipe 9. However, the restrictor 34 is so dimensioned that the building up of pressure in the crankcase 11 is not affected to any considerable extent.

Figure 3C:
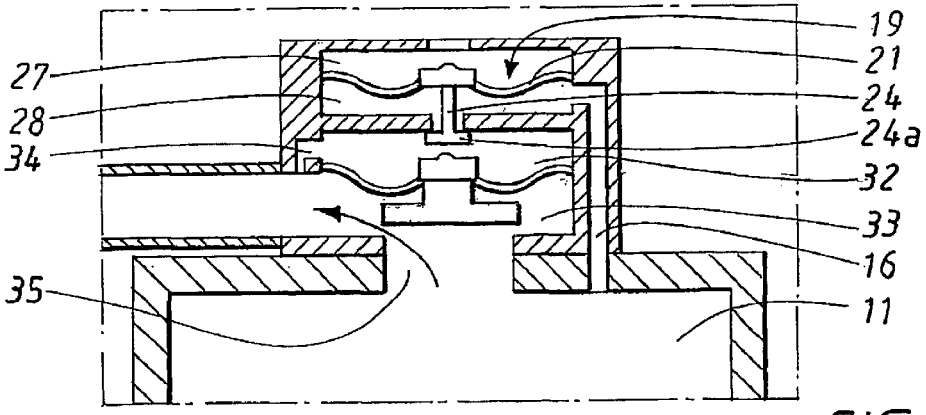

If the pressure in the crankcase 11 should exceed a maximum permissible limiting value, the valve device 15 will assume the condition that is shown in FIG. 3*c*. In this regard, the first valve 19 will be influenced towards its closed condition as a consequence of the prevailing high pressure in the crankcase 11 (and thus also in the pipe 16) affecting the first diaphragm 21 in a direction in which the valve element 24*a* sealingly bears against corresponding opening 25. In this case, the pressure in the third chamber 32 will gradually drop towards a value which corresponds to the pressure in the suction pipe 9 due to the fact that gas is allowed to flow to the suction pipe 9 via the restrictor 34.

Finally, the pressure in the third chamber 32 will have dropped to a value at which the pressure in the crankcase 11 is capable of opening the second valve 20, wherein passage of crankcase gases via the opening 35 is allowed. This in turn implies that the pressure in the crankcase 11 decreases. When the pressure has dropped so much that it once again falls within its permissible interval, the second valve 20 will once again be closed, due to the influence from the spring element 36.

Thus, it can be established that the first valve 19 can assume an opened position or a closed position depending on the detected pressure in the crankcase 11. Furthermore, the second valve 20 can assume an opened position or a closed position (i.e. for opening and closing, respectively, the opening 35) depending on the condition of the first valve 19. Thus, by means of the invention, a servo function is provided where the condition of the first valve 19 affects the adjustment of the second valve 20. In this case, the control of the second valve 20 takes place by means of the movement of the first valve 19. This movement can be made very small, which is an advantage since the first valve 19 in this manner can be formed with a small and light rubber diaphragm, which in this case does not affect the control by means of factors which are due to the rubber diaphragm's own movements and the forces that it generates.

The invention is not limited to the fact that the respective valves 19, 20 are controlled so that they only assume two extreme positions. In other words, the valves 19, 20 can assume positions which lie between the extreme positions which are defined by means of the completely closed and the completely opened conditions. For example, during normal operation of the associated engine, both valves 19, 20 can be half opened or adjusted within a control area which is constituted by a restricted interval between the completely opened and the completely closed position of the respective valve.

By means of the fact that the valve device 15 comprises two valves 19, 20 with the above-mentioned servo function, it can be formed as a compact unit which can be easily mounted in connection with a combustion engine, for instance, in an area of the vehicle where the available space already is considerably limited.

According to the illustrated embodiment, the valve device 15 is provided after (i.e. downstream of) all the three separation devices 12, 13, 14 as exemplarily shown in FIG. 1. This implies that the separation devices are not exposed to the high underpressure which can occur on the engine's suction side during operation. This is an advantage for at least the fact that no non-return valve needs to be utilized in connection with the draining pipe 18 in order to stop oil from being sucked into the suction pipe 9.

In spite of the fact that the valve device 15 is situated downstream of the separation devices 12, 13, 14, the measuring of the crankcase pressure nevertheless takes place in the crankcase 11, via the pipe 16. This implies that the control of the pressure in the crankcase takes place independently of the fall of pressure in the separation devices 12, 13, 14.

The invention is not limited to the embodiments described above, but may be varied within the scope of the appended claims. For example, the invention can be utilized in various types of vehicles, for example passenger cars, lorries, loaders and buses that have engine adapted for closed crankcase ventilation.

The invention can be utilized in turbo charged engines, as well as engines without turbo charging.

The invention can be realized by means of various types of separation devices. In principle, the invention can be utilized even if no separation device is being utilized.

Furthermore, the above-mentioned spring element 35 can in principle be omitted, which may be relevant in those applications where the pressure difference between the crankcase and the suction pipe is comparatively small.

The above-mentioned diaphragms 21, 29 are preferably constructed from an elastic and oil-resistant material. For example, they can be made of rubber, but other materials with similar characteristics may also be utilized for this purpose.

What is claimed is:

1. A valve arrangement for providing pressure control in a combustion engine (1) with a crankcase (11) to which crankcase gases are guided during operation of the engine, said valve arrangement comprising:

valve means (15) for detecting the current pressure in said crankcase (11) and for opening and closing, respectively, a connection (35) between said crankcase (11) and a suction pipe (9) of the engine depending on said detected pressure; and said valve means (15) comprising: a first valve (19) that assumes a configuration between a first, opened position and a second, closed position depending on detected pressure in the crankcase (11), and a second valve (20) that assumes a condition between a first, opened position and a second, closed position depending on the condition of said first valve (19), and said second valve (20) opens said connection (35) when the first valve (19) assumes a closed position, and said second valve (20) closes said connection (35) when the first valve (19) assumes an opened position.

2. The valve arrangement as recited in claim 1, wherein said first valve (19) assumes a closed position when the pressure in the crankcase (11) exceeds a predetermined maximum permissible value, and said first valve (19) assumes an opened position when the pressure in the crankcase (11) falls below a predetermined minimum permissible value.

3. The valve arrangement as recited in claim 1, wherein said first valve (19) comprises a flexible diaphragm (21) which, depending on said detected pressure, causes a valve element **(24*a*) to open and close an opening (25) which connects the first valve (19) with the second valve (20), and the second valve (20) comprises a flexible diaphragm (29) which, depending on the condition of the first valve (19), opens and closes said connection (35)**.

4. The valve arrangement as recited in claim 3, wherein said flexible diaphragms (21, 29) are rubber diaphragms.

5. The valve arrangement as recited in claim 1, wherein said second valve (20) comprises a spring element (36) that influences the second valve (20) with a force biased toward closing connection (35).

6. The valve arrangement as recited in claim 1, wherein said valve device (15) detects the pressure in the crankcase (11) via a pipe (16) connected from the crankcase (11) to the first valve (19).

7. The valve arrangement as recited in claim 3, wherein said diaphragm (21) in the first valve (19) separates a first chamber (27) from a second chamber (28), and wherein the first chamber (27) is connected to the surrounding atmosphere and the second chamber (28) is connected to the crankcase (11), and said diaphragm (29) in the second valve (20) separates a third chamber (32) from a fourth chamber (33), and wherein the third chamber (32) is connected with the suction pipe (9) via a restrictor connection (34) and the fourth chamber (33) is connected with the suction pipe (9) and the crankcase (11), via said connection (35), and wherein the valve element **(24*a*) in the first element (19) cooperates with a connection (25) between the second chamber (28) and the third chamber (32)** which can be opened.

8. The valve arrangement as recited in claim 1, further comprising an engine having at least one separation device (12, 13, 14) for separating small particles from said crankcase gases, which separation device (13, 14, 15) is provided between the crankcase (11) and the suction pipe (9) and said connection (35) is provided downstream of said separation device (12, 13, 14).

9. An engine arrangement comprising:

an engine with a crankcase (11) and a connection for ventilating crankcase gases from the crankcase (11) to a suction pipe (9) via a connection (35) which can be opened;

a valve device (15) configured to detect the current pressure in said crankcase (11) and for opening and closing, respectively, a connection (35) between said crankcase (11) and a suction pipe (9) of the engine depending on said detected pressure; and said valve device (15) comprising: a first valve (19) that assumes a configuration between a first, opened position and a second, closed position depending on detected pressure in the crankcase (11), and a second valve (20) that assumes a condition between a first, opened position and a second, closed position depending on the condition of said first valve (19), and said second valve (20) opens said connection (35) when the first valve (19) assumes a closed position, and said second valve (20) closes said connection (35) when the first valve (19) assumes an opened position.

10. A method for pressure control in a combustion engine (1), said method comprising:

feeding crankcase gases during operation of the engine from a crankcase (11) forming part of the engine;

detecting the current pressure in said crankcase (11) and opening and closing a connection (35) between the crankcase (11) and a suction pipe (9) of the engine depending on the detected pressure;

controlling a first valve (19) between a first, opened position and a second, closed position depending on said detected pressure in the crankcase (11);

controlling a second valve (20) between a first, opened position and a second, closed position depending on the condition of said first valve (19); and opening said connection (35) when the first valve (19) assumes a closed position and closing said connection (35) when the first valve (19) assumes an opened position.

11. The method as recited in claim 10, further comprising:

closing the first valve (19) when the pressure in the crankcase (11) exceeds a predetermined maximum permissible value, and opening the first valve (19) when the pressure in the crankcase (11) falls below a predetermined minimum permissible value.

* * * * *